US005887759A

United States Patent [19]

Ayigbe

[11] Patent Number: 5,887,759

[45] Date of Patent: Mar. 30, 1999

[54] LIQUID DISPENSER FOR MOISTENING PAPER ARTICLES

[76] Inventor: Ayomore Ayigbe, 531 Harper Ave., Glenwood, Ill. 60425

[21] Appl. No.: 870,367

[22] Filed: Jun. 6, 1997

[51] Int. Cl.[6] ..... B67D 1/07; B65D 88/54; B05B 13/02

[52] U.S. Cl. ..... 222/192; 222/321.7; 222/321.9; 239/52; 242/905; 118/325

[58] Field of Search ..... 222/192, 321.7, 222/321.9; 118/325; 242/905; 239/52

[56] References Cited

U.S. PATENT DOCUMENTS

| | | | |
|---|---|---|---|
| 3,495,571 | 2/1970 | Evans | 118/325 |
| 3,865,271 | 2/1975 | Gold | 221/96 |
| 3,927,804 | 12/1975 | DeMan | 222/136 |
| 4,798,312 | 1/1989 | Scheiber | 222/180 |

FOREIGN PATENT DOCUMENTS

| | | | |
|---|---|---|---|
| 887478 | 1/1962 | United Kingdom | 242/905 |

*Primary Examiner*—Andres Kashnikow
*Assistant Examiner*—Keats Quinalty
*Attorney, Agent, or Firm*—Jack Shore; Hammon & Benn

[57] ABSTRACT

A dispenser for moistening paper articles consisting of an H-shaped structure in which the central section and the end sections together serve as a reservoir for a liquid such as a disinfectant or moisturizer. The dispenser fits over a roll of toilet tissue and the central section includes a spray pump for directing a fine mist spray onto sheets of toilet tissue. If desired, the roll support can be a unitary part of the dispenser assembly.

7 Claims, 3 Drawing Sheets

LIQUID DISPENSER FOR MOISTENING PAPER ARTICLES

FIELD OF THE INVENTION

The present invention relates to a device for dispensing a liquid, such as a disinfectant, antibacterial solution, cleansing agent, or moisturizer onto sheets of a toilet paper roll to moisten it for use for cleaning a toilet seat or skin areas of the user where cleansing is desired. The availability of a small, inexpensive, efficient device for moistening tissue to sanitize a toilet seat and provide added comfort and cleaning to anal and/or genital skin surfaces after evacuation has long been desired from a sanitary and cleanliness standpoint. The invention is also useful for moistening paper towels, if desired.

PRIOR ART

There have been a variety of prior art devices used for moistening a toilet paper and the like which has generally employed the use of water from the toilet tank and in so doing it has been difficult to control the wetness. By being unable to control the wetness, the tissue strength has been weakened to where the tissue may disintegrate. Other devices have consisted of separate supply systems for moistening toilet tissue, but these have been bulky, relatively inefficient, and expensive. In addition, some devices have generally only been used for moistening the tissue separate and apart from the roll of tissue and not usable in conjunction with a roll of toilet tissue which can be mounted with respect to the dispenser and thus make for a simple compact unit that surrounds the roll and thus require very little space.

A number of prior art patents disclosing systems which have been used in conjunction with toilets are set forth in Warkentin U.S. Pat. No. 5,381,568, Hamlin U.S. Pat. No. 4,598,664, Taft U.S. Pat. No. 3,776,6773, and Nibler U.S. Pat. No. 4,451,943. These are subject a variety of disadvantages in that they require installations within a toilet tank, separate spaced units, or require separation of sheets of tissue from a roll before moistening that are not conveniently usable, somewhat bulky, and/or expensive.

SUMMARY OF THE INVENTION

In accordance with the present invention, there is provided a small, compact and inexpensive liquid dispenser for moistening sheets of a paper roll. The unit can be mounted on a wall or other surface adjacent a toilet to surround roll of tissue. The dispenser would include a pump spray means to provide a small very fine mist on the adjacent sheets of tissue which would materially enhance cleaning but result in negligible interference with tissue strength. The dispenser is easy to install and requires no costly connections to external pumping. The dispenser contains a reservoir and a pump and conduit arrangement for the liquid to be sprayed, which reservoir can be readily filled. In addition, it can be made childproof by preventing actuation of the pump unless it is to be used. The novel dispenser disclosed herein will dispense a predetermined amount of liquid upon actuation to dispense a fine spray pattern across the paper. Various types of liquid can be sprayed, such as a disinfectant consisting of propylene glycol mixed with water, other antiseptic products, moisturizers, or other suitable liquids. In addition, in one embodiment of the present invention, the holder for the tissue roll can be included as part of the dispenser assembly, which would only require a single mounting arrangement.

BRIEF DESCRIPTION OF THE DRAWINGS

The various features and advantages of the invention will be apparent from the attached drawings in which.

DESCRIPTION OF THE INVENTION

Figure 1:
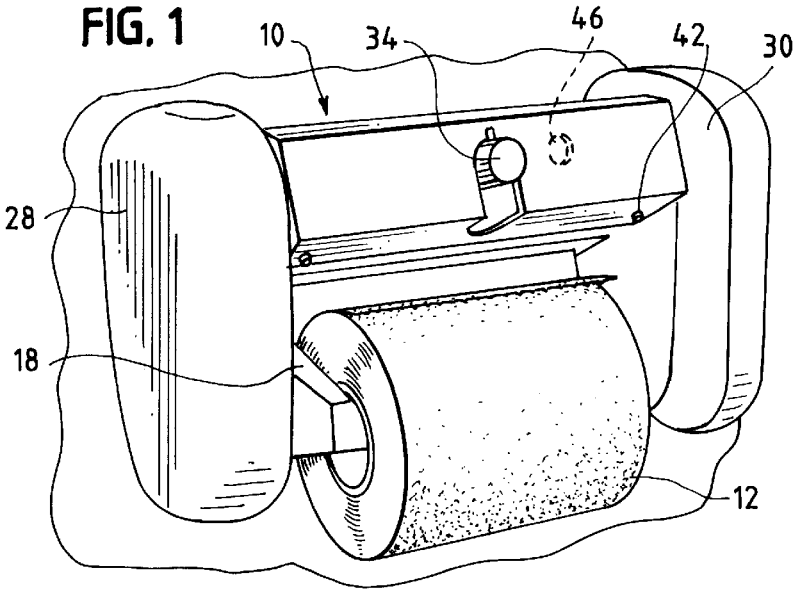
FIG. 1 shows a perspective view of the novel liquid dispenser being mounted in position on a wall surrounding a roll of toilet paper located on a separate mount support.

Referring now to FIG. 1, there is illustrated the dispenser 10 which is generally H-shaped. Located below the central portion thereof and between its ends is a toilet tissue roll 12 mounted on a roll support frame 14. The roll support frame 14 includes a back support 16 that is adapted to be suitably secured to a wall below the portion of the wall to which the dispenser is also suitably connected. Extending from the back support 16 are forwardly extending arms 18, 20 that include in the ends thereof cylindrical openings 22. Disposed in the openings 22 is a cylinder 24 for receiving a roll of toilet paper. The cylinder 24, by way of example only, is a conventional two-piece, spring-biased type that can be made shorter and withdrawn from the arms 18, 20. To position the tissue roll 12 on the support frame 14, the cylinder 24 is extended through the center tube of the tissue roll and returned to its mounting position in the openings 22 in the arms 18, 20 to maintain the roll in position.

Turning now to the details of the dispenser, the reservoir portion consists of a central, hollow section 26 and integral vertically elongated hollow end sections 28, 30 that are in communication with central section 26.

Figure 3:
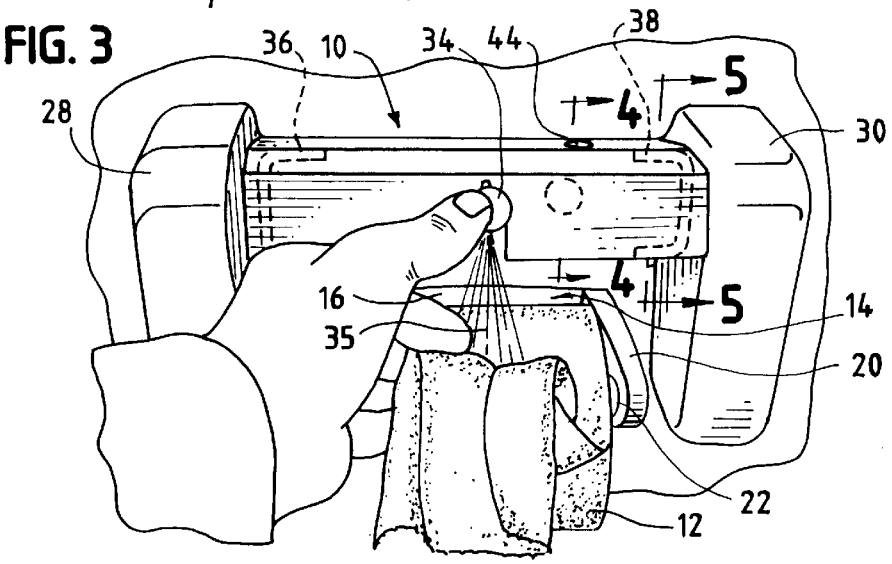
FIG. 3 is a view similar to FIG. 2 in which the spray pump is actuated to dispense a spray of liquid on tissue sheets.
Figure 6:
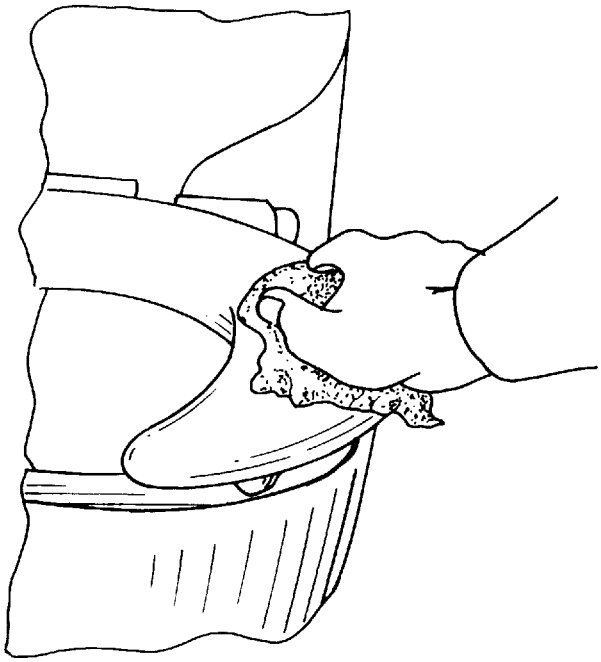
FIG. 6 is a perspective view showing a moistened tissue being used to clean a toilet seat.
Figure 9:
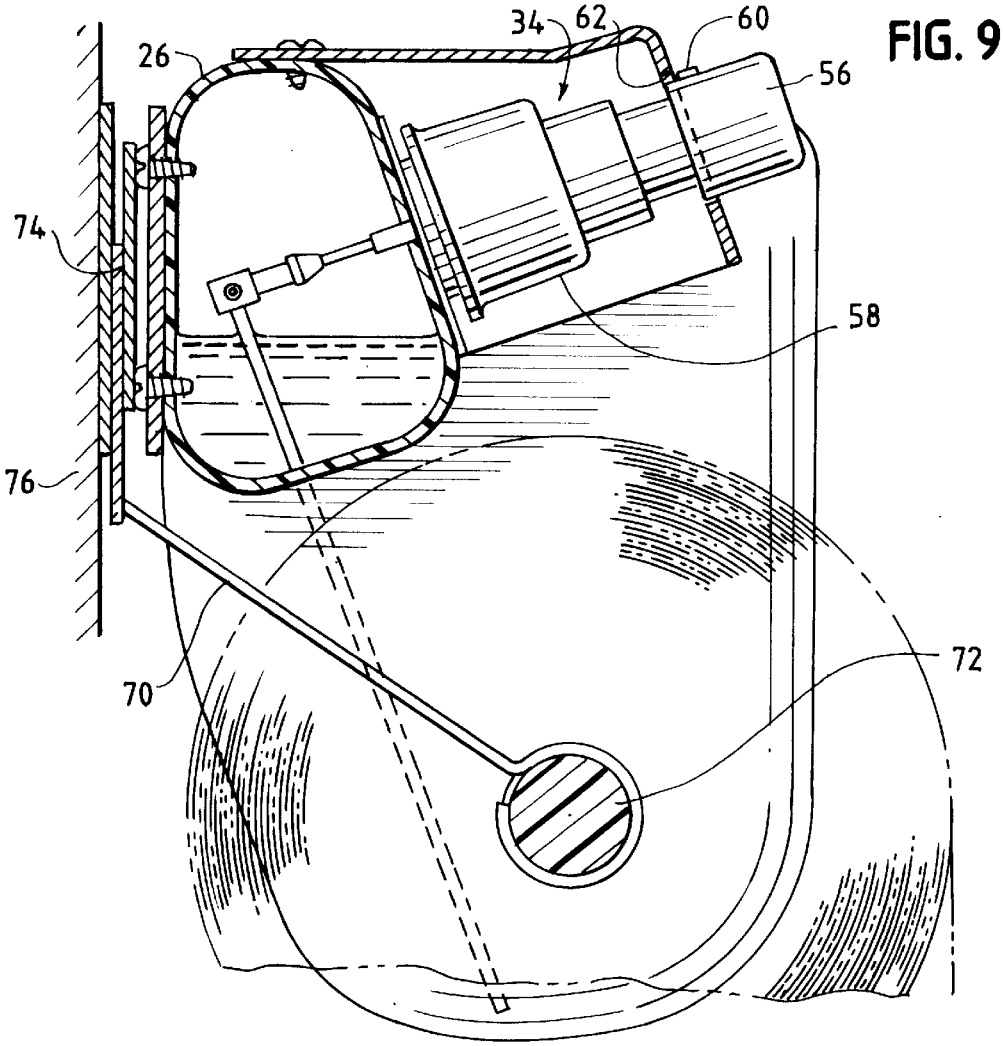
FIG. 9 is a cross-sectional view showing an embodiment in which the mounting for the tissue roll is part of the dispenser assembly.

Connected to the center section 26 is a plate 32 (see FIG. 7) to which is connected a pump assembly 34 consisting of a pushbutton arrangement as shown in FIG. 9. As shown in FIG. 3, the pump assembly when actuated directs a spray 35 onto the sheets being withdrawn from tissue roll 12 to provide a fine light mist to moisten the tissue but not weaken it to where it will disintegrate due to excessive liquid being sprayed thereon.

Figure 5:
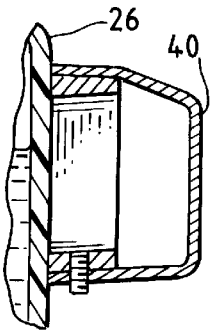
FIG. 5 is a section taken along line 5—5 of FIG. 3.

To enclose the central section to prevent access thereto and to provide a surface for appropriate identifying information, a cover 40 is located over and connected to the central section while providing access to the pump assembly 34. To connect the cover to the central section 26, channel sections 36, 38 are connected to the vertical end sections 28, 30, respectively. The cover 40 is disposed over the channel sections (see FIGS. 5 and 7) and the cover 40 is retained in position relative to the central section by screws 42 that extend through aligned openings in cover 40 and the channel sections 36, 38.

Figure 4:
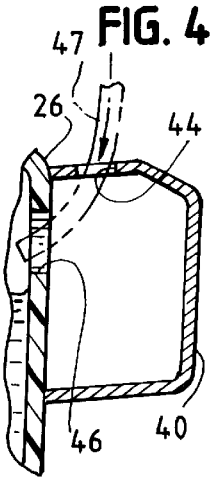
FIG. 4 is a section taken along line 4—4 of FIG. 3.
Figure 2:
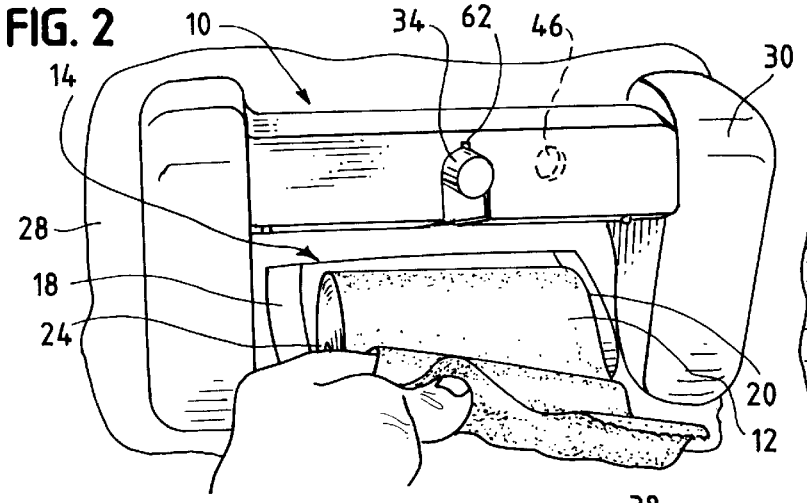
FIG. 2 is a front view similar to FIG. 1 showing tissue being withdrawn from the roll.

In order to fill the dispenser 10 when it becomes low in liquid, there is provided an opening 44 in the cover 40 and an opening 46 in the front wall of the center sections 26. A tube 47 for filling the reservoir is shown in dotted lines in FIG. 4. The liquid is introduced into the central section and drawn into end sections 28 and 30 as shown in FIG. 7.

Figure 7:
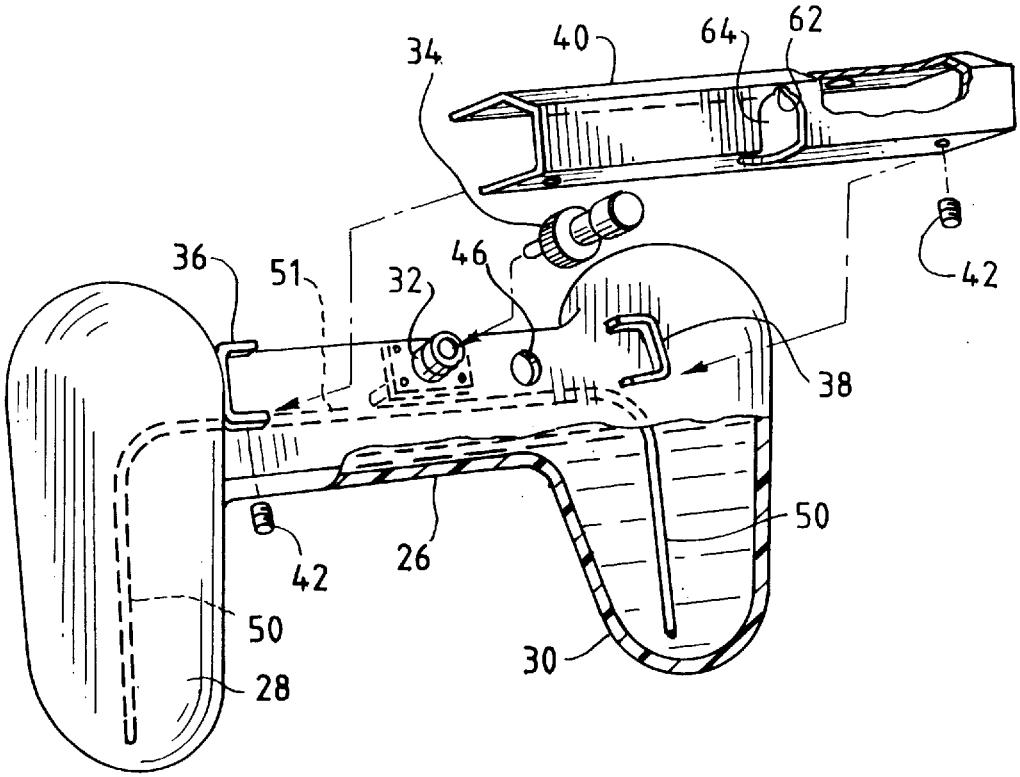
FIG. 7 is an exploded perspective view showing the cover guard removed from the dispenser.

In FIG. 7, there is shown the conduit connection from the pump assembly 34 to the bottom of end sections 28 and 30. This connection consists of downwardly extending tubes 50 that connect to a central conduit 51 leading from the pump assembly 34. It can be appreciated that the pump can take many forms and the embodiment illustrated in FIG. 9 is a conventional spray pump 34 that when the plunger 56 is pushed forward, liquid in the pump is sprayed out through a nozzle (not shown) in pump section 58 to form a fine mist spray, and when the plunger portion is released, it is moved backward by a suitable spring, or the like, and a check valve is then opened to permit additional liquid to be introduced into the pump chamber, thus permitting a subsequent pumping and spraying action.

It is to be noted that the spray plunger has a longitudinally extending projection 60 that fits into a recess 62 formed in the outer part of the opening 64 formed in the central portion of the cover 40 through which the plunger extends. Thus, when the plunger is positioned with the projection 60 disposed in the recess 62, the plunger 56 can be pushed and the pumping action take place. If pumping action is not to occur, say, for example, to prevent the constant pumping by children, the plunger is rotated 10°–20°, with the result that the plunger cannot be pushed forward due to the projection engaging the cover 40 and thus spraying will not take place.

Figure 8:
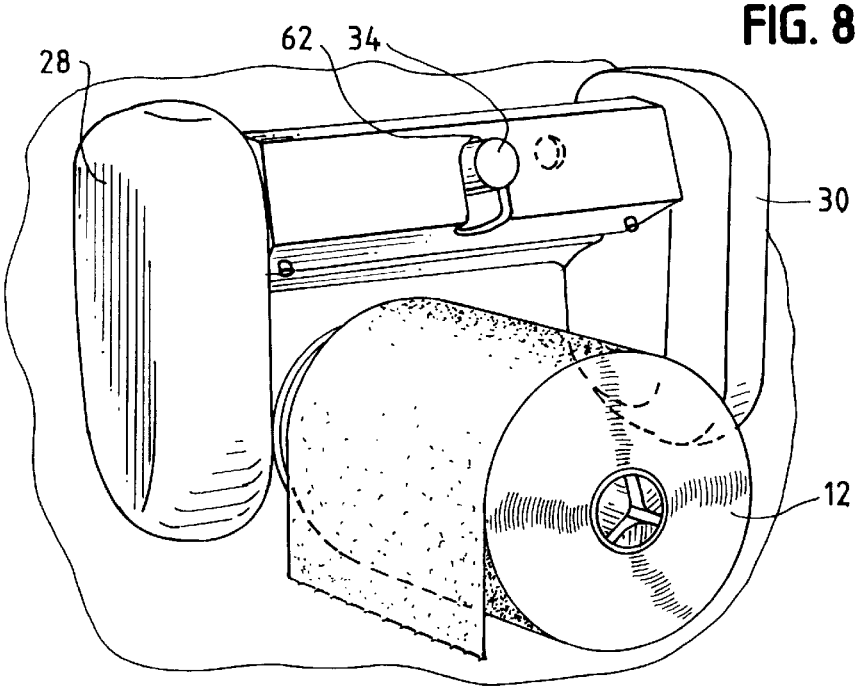
FIG. 8 is a view similar to FIG. 1 in which the roll is disposed on an axis normal to the front view of the dispenser.

Referring now to FIG. 8, there is another embodiment employing a novel dispenser assembly in which the axis of the roll of tissue 12 is located normal to the central, hollow section 26 of the dispenser. In this case, there is a bracket connected to the wall to which a cylindrical member extending outwardly therefrom is connected. The center core of the toilet paper roll may be mounted and located in place thereon.

The embodiment illustrated in FIG. 9 consists of a dispenser assembly that includes as a portion thereof depending arms 70 that support a cylindrical member 72 about which a tissue roll 12 is disposed. The roll holder construction permits removal of the central core of the roll after the tissue has been unwound and replacement of a new roll. The dispenser and roll support are a single unit that is secured to a plate assembly 74 that can be affixed to the wall 76 in any suitable fashion, such as by screws, glue, etc. This contrasts with the other embodiments illustrated in which the tissue roll support means was a separate unit located between the two vertically extending end sections of the dispenser unit.

It will be appreciated that this application covers all such embodiments and modifications that fall within the true spirit and scope of the claims provided hereinafter.

What is claimed is:

1. A liquid dispenser for use with a paper means, comprising a generally H-shaped reservoir having a generally hollow central section and generally hollow end sections depending from said central section (adapted) that serves as both a support frame and a liquid container and positioned to be disposed over said paper means, and spray means including a pump and duct means with said duct means extending from said pump into the bottom of said hollow end sections, in which said spray means is in communication with said central section for dispensing liquid onto said paper means for moistening same.

2. A dispenser in accordance with claim 1 in which the spray means includes a pump and duct means extending into said end sections.

3. A dispenser in accordance with claim 1 in which the paper means is a roll of toilet tissue and the spray means includes a nozzle for emitting a fine mist over said tissue which will not substantially weaken said tissue.

4. A liquid dispenser for use with a roll of toilet paper, comprising a main support structure including a reservoir having a hollow central section and hollow end sections depending from and communicating with the central section, said central section positioned to be disposed over said roll of toilet paper, and spray means in communication with said central section and aligned with said toilet paper as said toilet paper is dispensed.

5. A dispenser as set forth in claim 4 including a cover located over said central section and defining an opening for said spray means to extend therethrough, and means for connecting said cover to said central section.

6. A dispenser as set forth in claim 5 in which the connection means comprises channel sections and fastening means for securing the cover to the channel sections.

7. A dispenser as set forth in claim 5 in which said spray means includes a pump comprising an outer plunger section that includes a projection and the opening in said cover defines a recess for receiving said projection whereby when the projection is in alignment with said recess the pump can be actuated but when the projection is out of alignment the plunger section cannot be pressed.

* * * * *